US011045941B2

(12) United States Patent
Godfrey

(10) Patent No.: US 11,045,941 B2
(45) Date of Patent: Jun. 29, 2021

(54) GUIDE APPARATUS FOR A WOODWORKING ROUTER

(71) Applicant: Woodrat Ltd., Godney (GB)

(72) Inventor: Martin Godfrey, Godney (GB)

(73) Assignee: WOODRAT LTD, Wells Somerset (GB)

( * ) Notice: Subject to any disclaimer, the term of this patent is extended or adjusted under 35 U.S.C. 154(b) by 148 days.

(21) Appl. No.: 16/306,222

(22) PCT Filed: Jun. 1, 2017

(86) PCT No.: PCT/GB2017/051563
§ 371 (c)(1),
(2) Date: Nov. 30, 2018

(87) PCT Pub. No.: WO2017/207995
PCT Pub. Date: Dec. 7, 2017

(65) Prior Publication Data

US 2019/0217461 A1 Jul. 18, 2019

(30) Foreign Application Priority Data

Jun. 1, 2016 (GB) ..... 1609598

(51) Int. Cl.
*B27C 5/10* (2006.01)
*B25H 1/00* (2006.01)

(52) U.S. Cl.
CPC ..... *B25H 1/0078* (2013.01); *B27C 5/10* (2013.01)

(58) Field of Classification Search
CPC .... B25H 1/0021; B25H 1/0042; B25H 1/005; B25H 1/0078; B27C 5/10; B23Q 9/00;
(Continued)

(56) References Cited

U.S. PATENT DOCUMENTS 1,361,664 A * 12/1920 Ashman ..... B25H 1/0078 408/111
1,829,393 A * 10/1931 Carter ..... B23C 1/06 409/185
(Continued)

FOREIGN PATENT DOCUMENTS

EP 2191946 A2 6/2010
ES 1038985 U 9/1998
(Continued)

OTHER PUBLICATIONS

International Preliminary Report on Patentability issued by the International Bureau of WIPO dated Dec. 4, 2018 in related International Application No. PCT/GB2017/051563, 7 pages.
(Continued)

*Primary Examiner* — Matthew Katcoff
(74) *Attorney, Agent, or Firm* — Gesmer Updegrove LLP

(57) ABSTRACT

A guide apparatus for guiding a woodworking router relative a workpiece, comprising: a base for engaging with a workpiece or worktable carrying the workpiece; a guide frame coupled to the base and having at least one guide defining a linear guide path; a router housing slidably engaged with the guide for movement along the guide path relative the guide frame in an engaging direction towards the base and a disengaging direction away from the base, the router housing being configured to receive a woodworking router so that, in use, a router bit of the router extends from the router housing towards the base; and an actuation mechanism having a pivotable handle for receiving an input force from an operator to move housing along the guide path. The actuation mechanism is configured so that an input force is required to raise the housing and the router received therein against gravity.

15 Claims, 7 Drawing Sheets

(58) Field of Classification Search
CPC .. B23Q 9/0064; B23Q 9/0071; B23Q 9/0078; B23Q 9/02; B23C 1/007; B23C 1/06; Y10T 409/306664; Y10T 409/30672; Y10T 409/36776; Y10T 409/30784; Y10T 409/307896; Y10T 409/307952; Y10T 409/308624
See application file for complete search history.

(56) References Cited

U.S. PATENT DOCUMENTS

| | | | | |
|---|---|---|---|---|
| 2,896,512 | A * | 7/1959 | Riedel | B23Q 11/0017 409/237 |
| 3,351,047 | A | 11/1967 | Barker | |
| 4,014,621 | A * | 3/1977 | Johnson | B23Q 16/001 408/16 |
| 4,082,474 | A | 4/1978 | Stiger | |
| 4,537,234 | A | 8/1985 | Onsrud | |
| 4,740,119 | A | 4/1988 | Lierz | |
| 5,143,494 | A | 9/1992 | McCurry | |
| 5,918,652 | A | 7/1999 | Tucker | |
| 6,223,794 | B1 * | 5/2001 | Jones | B23Q 11/005 144/135.2 |
| 6,264,406 | B1 * | 7/2001 | Bowles | B23Q 9/02 269/131 |
| 6,374,878 | B1 | 4/2002 | Mastley et al. | |
| 6,488,455 | B1 * | 12/2002 | Staebler | B23C 1/20 144/136.95 |
| 7,441,994 | B2 * | 10/2008 | Hsieh | B23C 1/06 408/137 |
| 2002/0164223 | A1 | 11/2002 | Ryan et al. | |

FOREIGN PATENT DOCUMENTS

| | | | |
|---|---|---|---|
| GB | 2453532 | A | 4/2009 |
| WO | 9633847 | A1 | 10/1996 |
| WO | 2008098080 | A2 | 8/2008 |
| WO | 2013104321 | A1 | 7/2013 |

OTHER PUBLICATIONS

International Search Report & Written Opinion issued by International Searching Authority in related International Patent Application No. PCT/GB2017/051563 dated Aug. 3, 2017, 18 pgs.

Woodgrain Productions Inc, 2015, "Router Tips", routerworkshop.com, [online], Available from: https://web.archive.org/web/20151122080513/http://www.routerworkshop.com/router_tip_glossary.html [Accessed Jan. 11, 2016]. See Section "General Routing: Removing your Springs".

United Kingdom Search Report issued by the Intellectual Property Office in related UK Application No. GB1609598.5 dated Nov. 2, 2016, 3 pgs.

Virutex, 2005, "Lock Mortiser Model FC161 operating instructions", Mar. 13, 2005 (Mar. 13, 2005), XP055393573, Retrieved from the Internet: URL:http://virutex.com/manuals/fc161-manual-english.pdf [retrieved on Jul. 25, 2017].

* cited by examiner

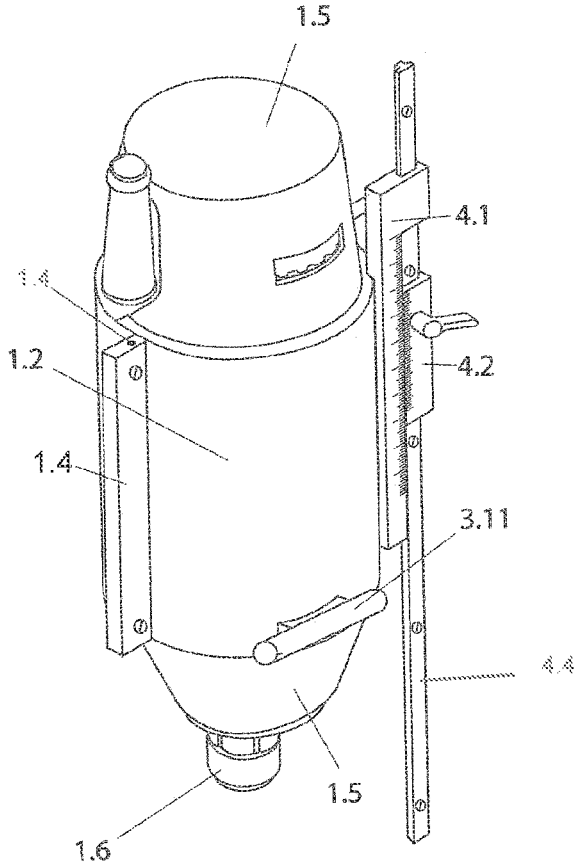
FIGURE 8.1
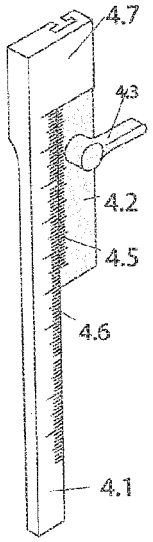
FIGURE 8.2
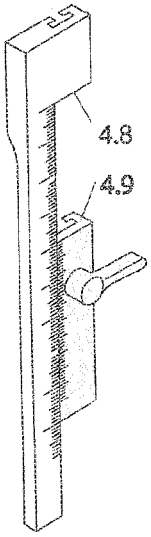
FIGURE 8.3
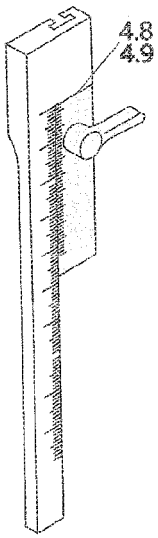
FIGURE 8.4

GUIDE APPARATUS FOR A WOODWORKING ROUTER

CROSS-REFERENCE TO RELATED APPLICATIONS

The present application is a U.S. National Stage filing under 35 U.S.C. 371(c) of International Application No. PCT/GB2017/051563, filed Jun. 1, 2017, which claims priority to Great Britain Patent Application No. 1609598.6, filed Jun. 1, 2016, the disclosures of which are hereby incorporated by reference in their entireties.

BACKGROUND

The invention relates to guide apparatus for a woodworking router.

Known plunge routers comprise a base in the form of a metal ring from which rise two columns with internal springs. The router motor is housed in a body mounted on these columns. The motor can be forced downward against the force of the springs by the operator pushing on handles on either side of the motor. The bit in the collet of the motor is thus brought down below the base of the router so that it can cut the workpiece and the motor can be locked onto the columns at any point.

The depth of the bit in a routing operation is invariably controlled by an adjustable depthing foot attached to the motor that is brought down onto a rotating "turret" of stops, set at different heights. The depth of cut is gauged between the foot and one of the stops on the turret.

If the bit is first 'zeroed' onto the work surface and the router locked, the depthing foot can be raised a gauged amount and locked off. This allows the bit to be lowered below the work surface the gauged amount and locked so that it can cut the work and make joints.

From the zero position the height of the depthing foot can be gauged using various means, which may be a drill bit shank or special gauges of engineered dimensions, or (commonly) the piece of wood that the joint will go through, or a dimension obtained from vernier or digital callipers. Often it can be difficult to introduce calipers between a stop and a depthing foot.

It invariably takes two hands pushing equally on the handles each side of the router to lower the motor. When the router is used upside down in a router table the weight of the router pushes downward and the springs also push downward doubling the weight. When the operator wishes to bring the bit above the table top to cut the workpiece, he pushes up with two hands against this force, thereby lifting the whole router table off the floor. Since both hands are pushing the router upward there is no third hand to push down on the table top to keep it on the floor. Users are reluctant to bolt tables to the floor, since it is often desirable to move them.

In order to function correctly, the sprung columns accommodate the axially extending springs with a degree of radial tolerance. This tolerance is transmitted as runout (i.e. undesirable movement of the blade that results in an oversized hole or pathway) at the cutter tip so there is a practical limit to the length of the columns before they become inaccurate, and therefore a limit to the depth of plunge of the bit. Runout can be considered as an eccentricity of a cut, or an amount by which the cut is off-centre, and can also be caused by poor sharpening of a bit, worn bearings of a router.

As the user unlocks the router from a locked vertical position, there is a tendency for the springs to cause the router to suddenly jump upward.

It is therefore desirable to provide a router apparatus (or guide apparatus for a router) that may mitigate some of the above mentioned problems.

According to a first aspect of the invention there is provided guide apparatus for guiding a woodworking router relative a workpiece, the guide apparatus comprising: a base for engaging with a workpiece or worktable carrying the workpiece; a guide frame coupled to the base and having at least one guide defining a linear guide path; a router housing slidably engaged with the guide for movement along the guide path relative the guide frame in an engaging direction towards the base and a disengaging direction away from the base, the router housing being configured to receive a woodworking router so that, in use, a router bit of the router extends from the router housing towards the base; and an actuation mechanism for moving the router housing along the guide path, the actuation mechanism comprising a pivotable handle for receiving an input force from an operator.

The actuation mechanism may be configured so that, in use with the guide apparatus in an upright configuration in which the router housing is above the base, an input force (e.g. an input force to the pivotable handle) is required to raise the housing and the router received therein against gravity. In the upright configuration the router housing may be suspended above the base.

Alternatively, the upright configuration may be defined as a position in which the router housing is movable downwards so that a router received therein engages with a workpiece, more particularly, so that a cutter received in the router engages the workpiece.

The actuation mechanism may be unbiased so that, in use, an input force must be applied to raise the housing and the router received therein against gravity.

The apparatus may be configured so that the router housing is not biased to move along the guide path by any force other than a gravity force acting on the housing and any router received therein.

The apparatus may be configured so that the router housing is biased to move along the guide path only by a gravity force acting on the housing and any router received therein.

The apparatus may be configured so that the router housing is not mechanically biased to move along the guide path, for example, by a spring.

The actuation mechanism may comprise a disengaging pulley mechanism for moving the router housing along the guide path in the disengaging direction. A pulley cable of the disengaging pulley mechanism may be coupled to the router housing so that the pulley cable is operable to pull the router housing away from the base.

The actuation mechanism may comprise an engaging pulley mechanism for moving the router housing along the guide path in the engaging direction. A pulley cable of the engaging pulley mechanism may be coupled to the router housing so that, in use, the pulley cable pulls the router housing towards the base. The disengaging pulley mechanism and the engaging pulley mechanism may be coupled to the pivotable handle and configured so that, in use, each pulley mechanism is in tension (i.e. each pulley mechanism prevents a pulley cable of the other pulley mechanism from becoming slack).

The or each pulley mechanism may comprise a handle pulley coupled to the pivotable handle at a location spaced from the pivot axis of the handle so that, in use, the displacement of the router housing along the guide path due to the displacement of the handle pulley is greater than the arc length displacement of the handle pulley.

The or each pulley mechanism may comprise a cable extending between, in order, a first pulley or fixing point on the guide frame, the handle pulley, and a second pulley or fixing point on the guide frame and the first and second pulleys or fixing points on the guide frame may be adjacent one another so that, in use, two lengths of the cable extending between the handle pulley and the first and second pulleys or fixing points respectively are substantially parallel.

The pivotable handle may comprise first and second handle arms to which the respective handle pulleys are mounted, and the handle arms may extend substantially perpendicular to one another, and may extend from the pivot of the pivotable handle.

In other embodiments, the first and second pulleys or fixing points on the guide frame may be spaced apart so that, in use, the angle between the two lengths of the cable extending around the handle pulley is at least 135°, at least 150°, at least 165° or substantially 180°.

The actuation mechanism may comprise a rack and pinion mechanism, wherein a rack gear is coupled to the router housing, and wherein a pinion is coupled to the guide frame and driven by rotation of the pivotable handle.

The guide may be a guide rail. The guide rail may comprise a groove for receiving a guide portion of the router housing (e.g. a projection from the router housing). The guide rail or groove may be defined between two opposing parts of the guide frame. The guide frame may be a two-part structure. The guide portion of the router housing may comprise a fin configured to be received in the groove. Alternatively, the guide rail may be a projection for engaging with a recess or groove in the router housing. The guide may be any formation suitable for engaging with a complementary formation of the router housing or coupled to the housing.

The guide frame may comprise at least two guide rails, and the router housing comprises at least two corresponding guide portions. The guide rails may be provided on opposite sides of the housing.

The guide frame may be pivotable with respect to the base to alter the incline of the guide path with respect to a workpiece.

A router-receiving portion of the housing may be pivotable with respect to a guide portion of the router housing engageable with the guide, and the router-receiving portion may be pivotable with respect to the guide portion, so that in use the incline of a router bit of a router received in the housing with respect to the guide path is adjustable.

The guide apparatus may further comprise a depth gauge for setting a maximum depth for a routing operation. The depth gauge may comprise a first gauge part constrained to move with the router housing and a second gauge part slidably coupled to the guide frame, the first and second parts may be configured to engage with one another so that the second part limits the range of movement of the router housing along the guide path in the engagement direction.

The guide apparatus may further comprise a main scale carried by or fixed with respect to the first gauge part, and a vernier scale carried by the second gauge part. Accordingly, in use a desired maximum depth can be set by offsetting the second gauge part from the first gauge part when the first gauge part is in a zero-depth position (or other known position) until the vernier scale indicates the desired maximum depth (or other value corresponding to the desired maximum depth). The main scale may be integral with the first gauge part. The vernier scale may be integral with the second gauge part.

The first gauge part may comprise a shoulder or stop arranged to abut the second gauge part, and the shoulder or stop may be disposed at least 70% along the length of the guide towards the end of the guide opposite the base. The depth gauge may be arranged so that the zero offset point of the main scale and vernier scale is separated from the workpiece along a direction parallel with the guide path by a distance of at least 25 cms, or by a distance of at least twice the maximum depth that can be set using the depth gauge. The distance may be at least 15 cms, or at least 10 cms. The distance may be at least three times or at least four times the maximum depth that can be set using the depth gauge. The depth gauge may be configured so that a depth can be set for a routing operation of at least 15 cms.

The second gauge part may comprise a lock for locking its position with respect to the guide frame. The lock may be a rotatable screw lock engageable with a guide frame, such as a T-bar coupled to the guide frame and engageable with the second gauge part.

The guide frame may define a guide path having a range of movement for the router housing at least 15 cms, for example at least 20 cms.

The actuation mechanism may be configured so that the router housing moves along the guide path in the disengaging direction when a grab-portion of the handle for receiving an input force from the operator moves in a direction substantially opposite the disengaging direction.

According to a second aspect of the invention there is provided router apparatus comprising a guide apparatus in accordance with the first aspect of the invention and a woodworking router received in the housing.

According to a third aspect of the invention there is provided router apparatus comprising a router table, a guide apparatus in accordance with the first aspect of the invention coupled to the router table so that the engaging direction is generally upward, and a woodworking router received in the router housing.

According to a fourth aspect of the invention there is provided a method of operating a router apparatus according to the second or third aspects of the invention, the method comprising coupling an actuator to the actuation mechanism, and coupling the actuator to a controller for carrying out a predetermined router operation.

For example, the actuator may be a stepper motor, and the controller may be a pre-programmed controller, such as a computer provided with control software including router operation instructions. Alternatively the controller may be a processor or computer configured to receive instructions for a router operation, for example from an operator of the same or a different computer, and to control the actuator accordingly.

BRIEF DESCRIPTION OF THE DRAWINGS

The invention will now be described, by way of example, with reference to the accompanying drawings, in which:

FIGS. 8.1-8.4 show the depthing mechanism of the guide apparatus.

As shown in FIGS. 1-8.4, the guide apparatus comprises a base 5.1 for engaging with a workpiece, a guide frame coupled to the base 5.1 and having at least one guide rail in the form of a groove defined between front and back parts 2.1, 2.3 of the guide frame, a router housing 1.2 slidably engaged with the guide rail for housing a router motor 1.5, and an actuation mechanism 3 having a pivotable handle 3.7 pivotably coupled to the base 5.1.

The router motor 1.5, its collet and bits, switching and electronics are as standard.

Figure 1:
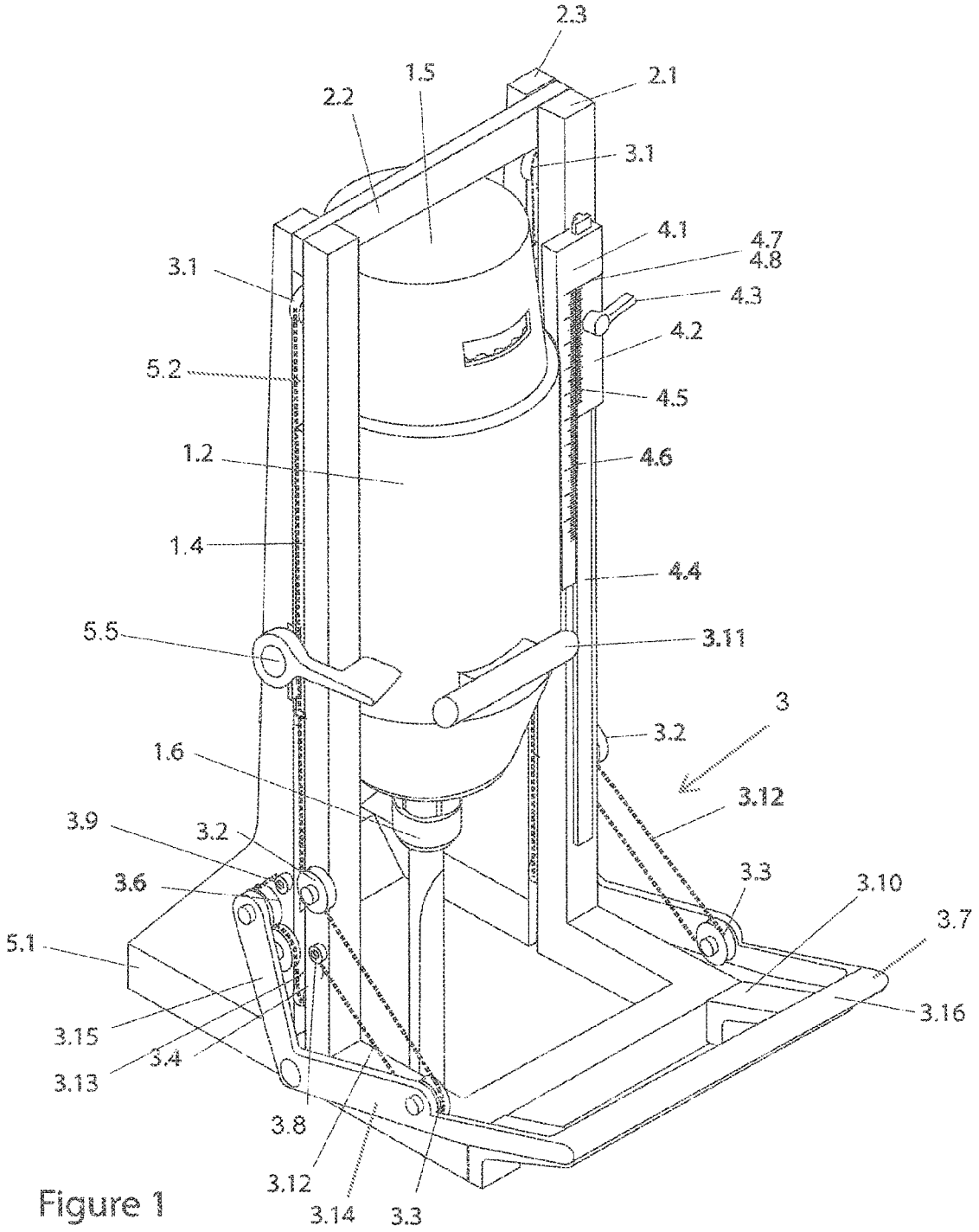
FIG. 1 schematically shows an isometric view of the guide apparatus in the upright configuration with the handle down and the router raised.
Figure 2:
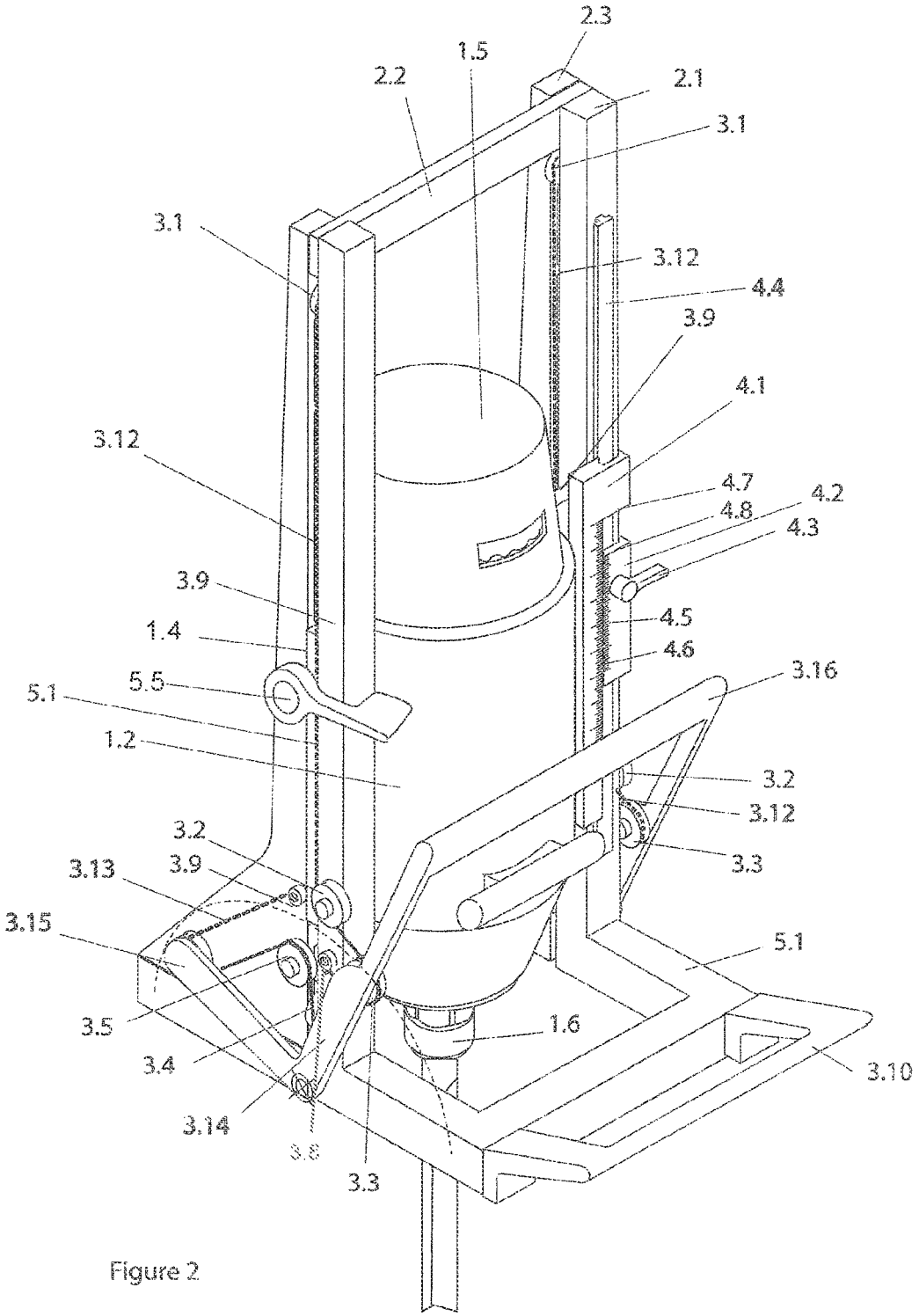
FIG. 2 schematically shows an isometric view of the guide apparatus in the upright configuration with the handle up and the router lowered FIG. 3 schematically shows a side elevation of the guide apparatus in the upright configuration with the handle up and the router lowered (handle shown down for reference only)
Figure 3:
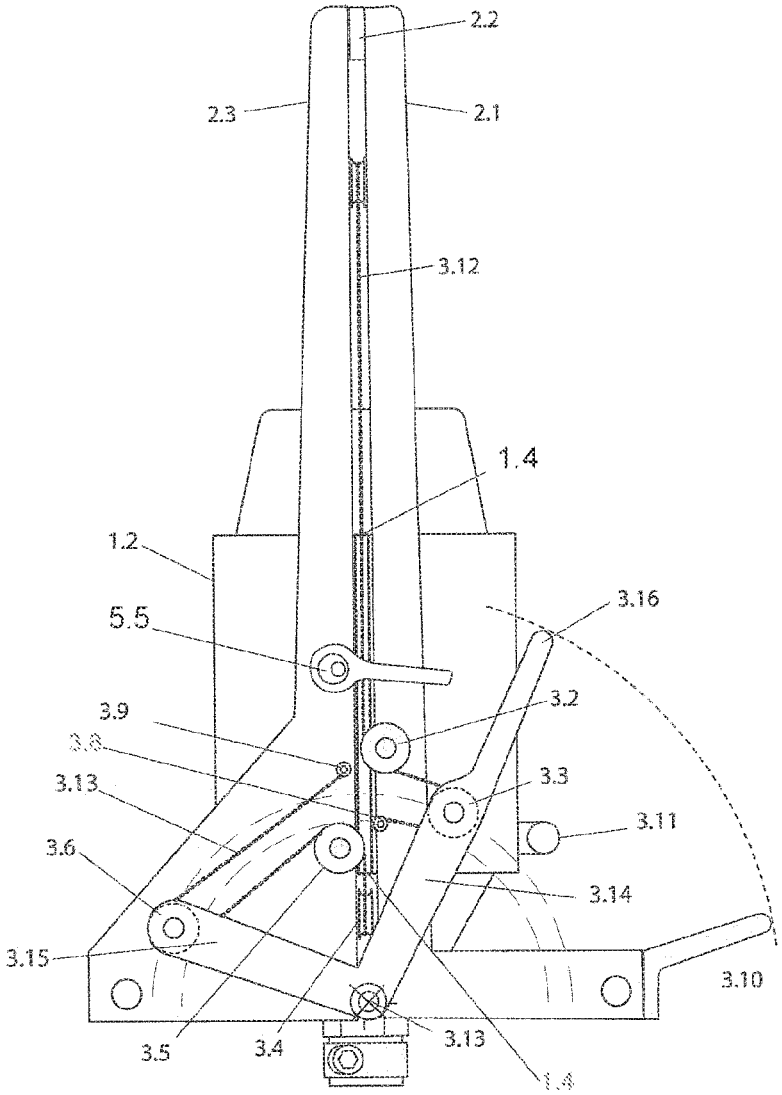
Figure 4:
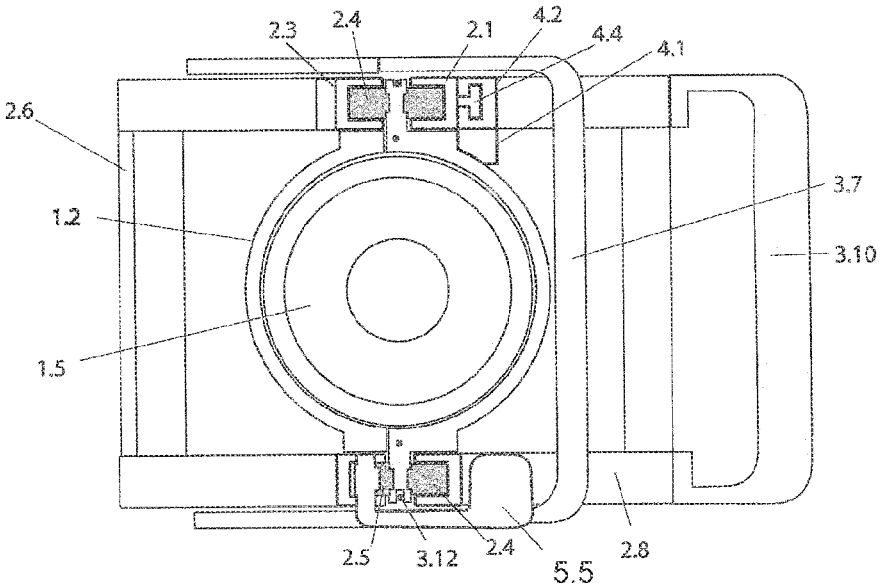
FIG. 4 schematically shows a plan view of the guide apparatus as shown in FIG. 3.
Figure 5:
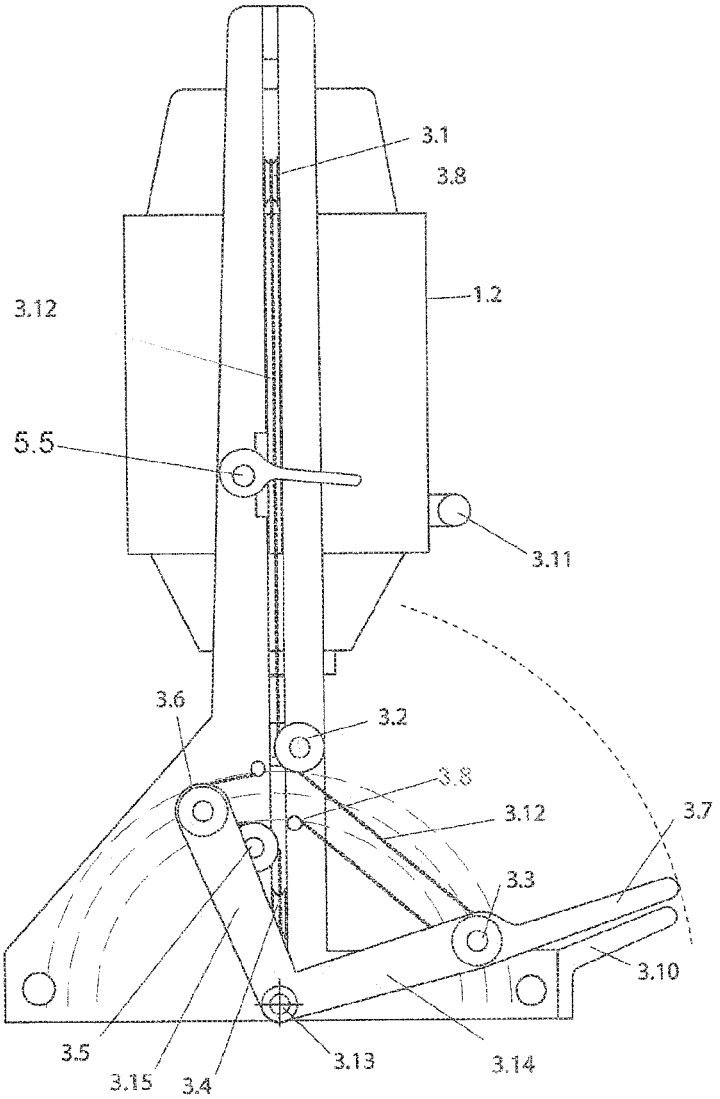
FIG. 5 schematically shows a side view of the guide apparatus with the router in a disengaged configuration.
Figure 6:
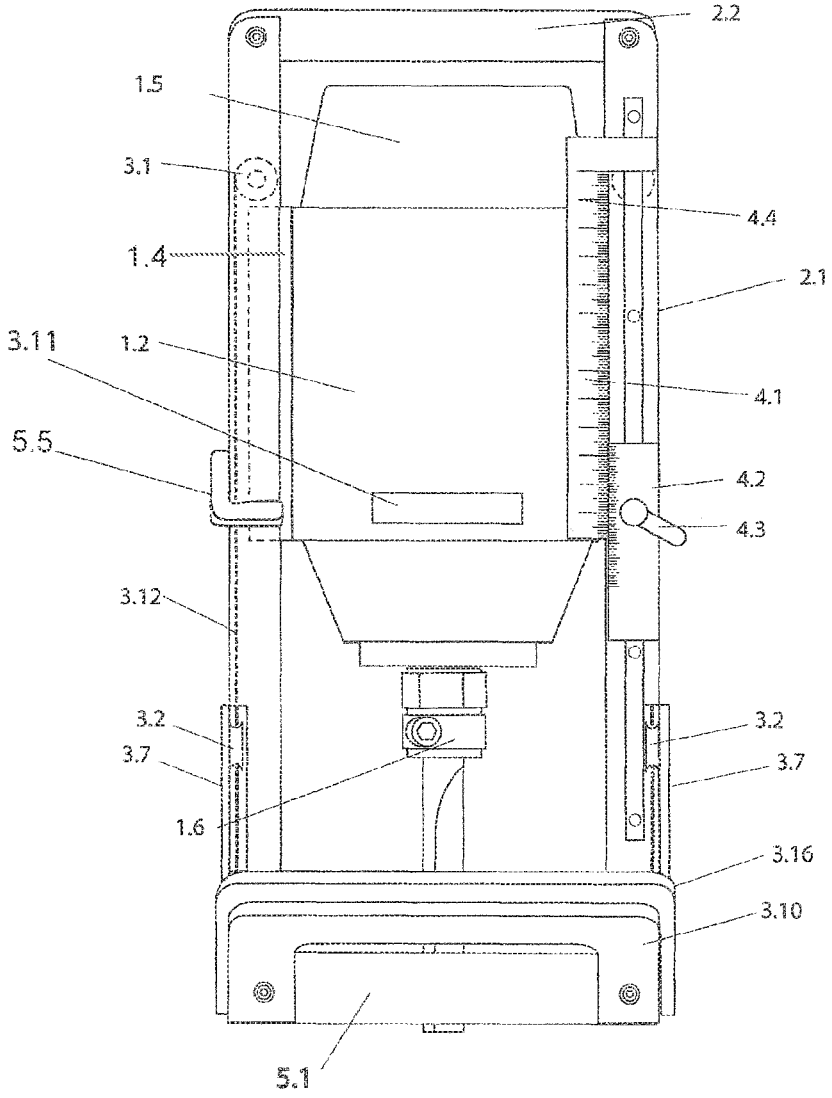
FIG. 6 schematically shows a front view of the guide apparatus.

The guide frame (or gantry) comprises two spaced apart posts, each defined by a front part 2.1 and a back part 2.3 with a space between them which defines a guide rail or groove 5.2. As best shown in FIG. 4, the front part 2.1 and back part 2.3 define a cavity therebetween in which respective inserts 2.4, 2.5 are received to define the guide rail 5.2. In this example, the inserts have opposing projections arranged to define a groove therebetween with a necked profile. In this embodiment, the guide frame is squarely attached to the base 5.1. The router motor 1.5 is an interchangeable motor which fits into the housing 1.2 that slides up and down in the guide frame (or gantry). The motor housing 1.2 is furnished with a vertical fin 1.4 on either side of it that slides in the guide rail 5.2 between the front and back part of the guide frame. In this example the fin has a vertical recess configured to cooperate with the necked profile of the guide rail 5.2. It can be stopped at any point with a brake 5.5 (such as a handle-operated friction brake installed on one of the guide posts and operable to clamp the posts together to stop the fin 1.4), but it can also be stopped by the stopping part 4.2 of a depth gauge, as will be described in detail below. In this particular example, the brake 5.5 is provided in the form of a friction-clamp mounted partway up one of the posts of the guide frame on one side (the back part) of the guide frame on a cammed rotational mechanism, and having a C-shaped handle configured to extend around the side of the post and engage the opposing front side. In use, the handle can be rotated to clamp the front part and back part of the post together against the fin 1.4, thereby braking movement of the housing 1.2.

The guide frame can be any reasonable height as it is not limited by the tolerances of a sprung column arrangement, as is found in previously considered plunger routers. Therefore, it can take longer bits, and thereby can cut deeper holes and deeper mortises than conventional plunger routers. In this embodiment, the guide frame is approximately 35 cms tall and defines a guide path having a travel of approximately 20 cms for the housing 1.2.

The router can be taken up to the top of the guide frame leaving a clear space below for changing the bits in the collet 1.6. This is particularly useful in a router table where there is restricted access up under the table.

A top rail 2.2 of the guide frame extending between the guide posts of the guide frame acts as a carrying handle, so that an operator's hands are clear of the cutting area when carrying it.

The housing 1.2 and motor 1.5 can be raised and lowered by an actuation mechanism of cables (such as wires or cords) 3.12, 3.13 and pulleys 3.1, 3.2, 3.3, 3.4, 3.5, 3.6 operated by the pivotable handle 3.7. The pivotable handle comprises a pair of first handle arms 3.14 and a pair of second first handle arms 3.15, although in other embodiments there may be only a single first handle arm 3.14 and a single second handle arm 3.15. In the upright configuration, in which the housing is suspended above the base, a handle pulley 3.3 mounted on a first handle arm 3.14 of the pivotable handle 3.7 is operable to draw the cable out from the router body by pulling the first handle arm 3.14 down toward the base 5.1 (i.e. a disengaged configuration of the handle 3.7), thereby pulling the motor up in the guide frame along a disengaging direction (i.e. away from the base 5.1 and workpiece). When the pull is relaxed, the router descends by gravity, resisted by the first handle arm 3.14 and the inherent tension in the pulley system. If the router is switched on, the weight of it will push the bit down to cut the work-piece. If off, the descent is arrested by the bit landing on the workpiece thereby zeroing the bit, or, the drop will be stopped by the stopping part 4.2 of the depth gauge locked onto a vertical tee rod 4.4 mounted on a guide post of the guide frame.

In a first embodiment, a first pulley system is configured to pull the router motor up (in the upright configuration) in a disengaging direction as the operator pulls the first handle arm 3.14 down, and gravity makes it fall down in an engaging direction when he/she releases the pull.

The first pulley system is arranged as follows. One end of the cable 3.12 is attached to the top of the fin 1.4 on one side of the housing 1.2. The cable 3.12 goes up and over a pulley 3.1 at the top of the guide frame post (mounted in the groove or guide rail defined between the guide frame parts), out and down to a pulley 3.2 on the front part of the guide post towards the base 5.1, then round a handle pulley 3.3 on the first handle arm 3.14 of the handle 3.7, and back to an adjustable fixture 3.8 adjacent to the pulley 3.2 on the front part 2.1. Pull down on a grab portion 3.16 of the handle 3.7 extending between the first handle arms 3.14 and the handle pulley 3.3 draws out the wire 3.12, thereby raising the motor. Raise the first handle arm 3.14 or release the pressure and gravity takes the motor down again. There is a fixed handle 3.10 below the first handle arm 3.14 and fixed to the router base. Abutment of the first handle arm 3.14 and the fixed handle 3.10 limit further pressure from being exerted on the router or the workpiece. In examples, a locking mechanism may be provided between the fixed handle 3.10 and the grab portion of the first handle to selectively lock the handle 3.7 in the disengaged configuration (i.e. when the grab portion 3.16 abuts the fixed handle 3.10), for example so that the router can be locked in a disengaged position in which the bit is clear of the workpiece.

In a further embodiment, and as shown in FIGS. 1-8.4, there is a second cable and pulley system configured to work counter to the first pulley system. In particular, when using the first pulley system alone, the cable may go slack when the bit stops against the work, or a stopping part 4.2 of the depth gauge. The second counteracting pulley system is arranged so that the cords 3.12, 3.13 are in tension on the cable at all parts of the travel of the motor, irrespective of orientation (i.e. in the upright or inverted configurations). In particular, the second counter system comprises a cable 3.13 that is attached to the underside of the fin 1.4 on one side of the housing 1.2, and which extends down and around a pulley 3.4 towards the base of the guide frame post and mounted in the groove or guide rail 5.2, out and up to a pulley 3.4 on the back part of the guide post towards the base 5.1, then round a handle pulley 3.6 mounted on the second handle arm 3.15 of the pivotable handle 3.7, and back to an adjustable fixture 3.9 adjacent the pulley 3.5 mounted on the back part 2.3 of the guide post. The first and second handle arms 3.14, 3.15 are integrally formed and extend perpendicularly with respect to each other from the pivot of the handle 3.7.

The first and second pulley systems are configured so that, in the upright configuration, as the first handle arm 3.14 goes down towards the fixed handle 3.10 (i.e. the disengaged configuration of the handle) so that the first pulley system pulls the cable 3.12 outward to raise the housing 1.2, the pulley 3.6 attached to the second handle arm 3.15 of the second pulley system moves towards the guide rail 5.2 so that the cable 3.13 is taken in, thereby allowing the housing 1.2 to rise.

Conversely, when the first handle arm 3.14 of the first pulley system is raised away from the base 5.1 and towards the router housing 1.2 (i.e. the engaged configuration of the handle), the second system pulls the cable 3.13 outward to draw the housing 1.2 down by a second set of pulleys 3.4, 3.5, 3.6 to engage a workpiece. In the upright configuration, gravity assists the downward movement of the motor to engage a workpiece. All slack is taken out of the system by tightening the two cables 3.12, 3.13 of the first and second (front and back) pulley systems against each other.

Handle pulleys 3.3, 3.6 are placed equidistant from the pivot point of the handle 3.7 on the respective handle arms 3.14, 3.15. Accordingly, as the handle pulley 3.3 on the first handle arm 3.14 moves away from the guide frame to draw the cable 3.12 outward (i.e. as the grab portion 3.16 coupled to the first handle arm 3.14 descends to draw the housing 1.2 upwardly), the handle pulley 3.6 on the second handle arm 3.15 moves towards the guide frame to allow the cable 3.13 to be drawn inwardly, therefore allowing the housing 1.2 to move upwardly. The integrally formed compound handle 3.7 operates the two systems together at the same time.

The distance the respective handle pulleys 3.3, 3.6 travel away from the guide frame results in double the travel distance of the housing 1.2, owing to the placement of the pulleys 3.2, 3.5 on the front and back parts 2.1, 2.3 respectively and the respective adjacent fixing points 3.8, 3.9. In particular, this arrangement means that the respective cables 3.12, 3.13 double back around the pulleys 3.3, 3.6 mounted on the handle arms 3.14, 3.15, so that the length of cable pulled and therefore the travel of the housing 1.2 is approximately twice the distance travelled by the respective handle pulleys 3.3, 3.6.

In addition, the first handle arm 3.14 provides a mechanical advantage as the length from the lateral grab portion 3.16 to the pivot is greater than the length from the handle pulley 3.3 mounted on the first handle arm 3.14 to the pivot. In practice the first handle arm 3.14 and grab portion 3.16 are squeezed together with the static handle 3.10 attached to the router base 5.1, to draw the router away from the workpiece in a disengaging direction. Conversely, the grab portion 3.16 may be urged against the router motor housing 1.2 when it is desired to move the rotor in the engaging direction, for example, to force the bit into the workpiece. In the particular embodiment shown in FIGS. 1-8.4, a laterally extending engaging handle 3.11 is provided on the router housing 1.2 and is positioned so that, as the grab portion 3.16 of the handle 3.7 is brought upwardly (in the upright configuration of the router) towards the engaged configuration of the handle, so that the router moves down in the engaging direction towards a workpiece, the grab portion 3.16 abuts the engaging handle 3.11, thereby limiting the travel of the router in the engaging direction. A user can grasp the engaging handle 3.11 and push the grab portion 3.16 of the handle 3.7 towards it in order to urge the router bit into a workpiece.

In contrast to previously considered plunge routers, there are no springs acting between the housing or motor and the guide frame or base.

As shown in FIGS. 1-8.4, in this embodiment first and second pulley systems are installed on both guide posts of the guide frame, which may ensure that in use there is no eccentric loading on the housing and router. However, in other embodiments, the first and second pulley systems may be installed on a single guide post on one side of the router housing only. In particular, the guide frame is configured so that there is a minimal tolerance (e.g. a running fit) between the guide rail (i.e. the groove between the front and back parts 2.1, 2.3) and the fins 1.4 of the housing received in the guide rail. Accordingly, even when the first and second pulley systems are installed on a single guide post, there should be no appreciable eccentricity in the movement of the housing 1.2.

As best shown in FIGS. 8.1-8.4, the guide apparatus comprises a two-part depth gauge. A first part 4.1 of the depth gauge is fixed with respect to the housing 1.2 and incorporates a main scale 4.6 and a shoulder 4.7 or stop projecting laterally from it at the zero point of the scale 4.6. A second part comprises a stopping part 4.2 (also referred to herein as a stop block) with a vernier scale 4.5 (or vernier stop) that is configured to slide vertically up and down on a tee rod 4.4 mounted on a guide post of the guide frame. The second part (stopping part 4.2) can be locked with a locking key 4.3 to the tee-rod 4.4 at any point below the main scale where it blocks the downward travel of the router.

The scale 4.6 is mounted on the housing 1.2 towards an end of the housing away from the base 5.1 so that it can be easily seen and operated. In use, the router bit is zeroed by lowering the housing, router or bit so that the bit touches the work to register the zero point, and the vernier stop block (stopping part 4.2 or the second part) is subsequently brought up to the underside of the projecting part of the shoulder 4.7 of the first part 4.1 corresponding to the zero point of the main scale 4.6. The main scale 4.6 of the first part 4.1, the vernier scale of the second part 4.2 and the bit are thus registered at zero (FIG. 8.2). The vernier stop block (stopping part 4.2) can then be taken downwards a gauged distance between opposing faces of the shoulder 4.7 of the first part 4.1 and the top 4.8 of the second part (stopping part 4.2) respectively, and locked off (FIG. 8.3). This therefore allows the router to drop that same gauged distance. The vernier stop (stopping part 4.2) therefore stops the router as it moves along the engaging direction, as required (FIG. 8.4).

In contrast, previously considered plunge routers invariably have a depth mechanism that is set towards the base of the router, and can therefore be difficult to see, particular when use in an inverted configuration underneath a router table.

The router itself may be locked off at depth by a separate locking mechanism, but the weight of the router held on the vernier stop is sufficient to keep the depth of cut constant and exact.

When the router is zeroed onto the workpiece, the gap between the underside of the projecting part of the shoulder 4.7 of the first part 4.1 and the top 4.8 of the second part (stopping part 4.2) determines the depth of cut. Gauging might be done from a vernier or digital calliper, or a gauging piece of some known depth such as a drill bit shank, or the thickness of a workpiece. As will be appreciated, the arrangement of the depth gauge away from the base 5.1 means that the gap between the projecting part of the shoulder 4.7 corresponding to the main scale and the vernier stop (stopping part 4.2) is easily accessible and can be gauged by such means or, the exact measured distance can be read off the vernier gauge between scale and vernier block with precision.

Figure 7:
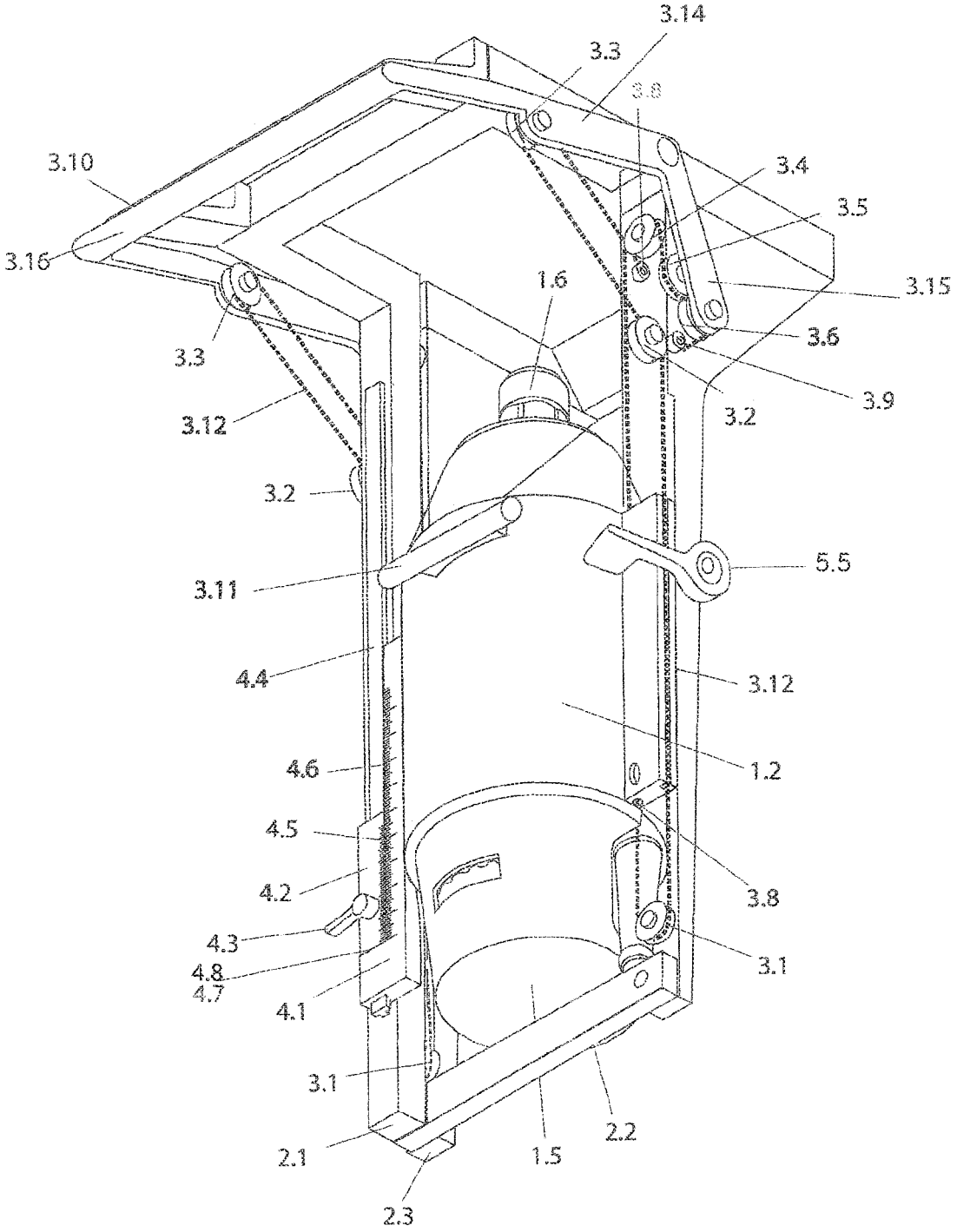
FIG. 7 schematically shows an isometric view of the guide apparatus in the inverted configuration with the handle raised and the router lowered.

As shown in FIG. 7, the guide apparatus can also be used in an inverted position in which the housing is suspended below the base. In particular, the guide apparatus may be used in a router table where it is positioned upside down. In the inverted configuration, the action of the guide apparatus is then reversed so that the second (or back) pulley system raises the router towards the bore and table in an engaging direction when pulling down on the grab portion 3.16 of the handle 3.7 (i.e. so that the grab portion is moved away from the fixed handle 3.10 towards the disengaged configuration of the handle), and conversely relaxing the handle causes the router to fall away from the base 5.1 and table, and the grab portion 3.16 to close against the fixed handle (i.e. in the disengaged configuration of the handle). The depth gauge is well clear of the underside of the router table, where it could otherwise be obscured by the table and fixings.

The applicant has found that the handle 3.7 can be operated with little force input, so that it can be easily operated with accurate control. In particular, the applicant has found that the "finger tip action" of the handle 3.7 means that mortising can be done with one hand, leaving the other hand free to operate a mortising or dovetailing jig. The added height and stability given by the guide frame means that longer bits can be used, cutting deeper mortises than are possible with known sprung column routers.

The invention claimed is:

1. A guide apparatus for guiding a woodworking router relative a workpiece, the guide apparatus comprising:

a base for engaging with a workpiece or worktable carrying the workpiece;

a guide frame coupled to the base and having at least one guide defining a linear guide path;

a router housing slidably engaged with the guide for movement along the guide path relative the guide frame in an engaging direction towards the base and a disengaging direction away from the base, the router housing being configured to receive a woodworking router so that, in use, a router bit of the router extends from the router housing towards the base; and an actuation mechanism having a pivotable handle for receiving an input force from an operator to move housing along the guide path;

wherein the actuation mechanism is configured so that, in use with the guide apparatus in an upright configuration in which the router housing is above the base, an input force is required to raise the housing and the router received therein against gravity, wherein the actuation mechanism comprises:

a disengaging pulley mechanism for moving the router housing along the guide path in the disengaging direction; and an engaging pulley mechanism for moving the router housing along the guide path in the engaging direction, wherein the disengaging pulley mechanism and the engaging pulley mechanism are coupled to the pivotable handle and configured so that, in use, each pulley mechanism is in tension.

2. The guide apparatus according to claim 1, wherein the disengaging pulley mechanism comprises a handle pulley coupled to the pivotable handle at a location spaced from the pivot axis of the handle so that, in use, the displacement of the router housing along the guide path due to the displacement of the handle pulley is greater than the arc length displacement of the handle pulley.

3. The guide apparatus according to claim 2, wherein the disengaging pulley mechanism comprises a cable extending between, in order, a first pulley or fixing point on the guide frame, the handle pulley, and a second pulley or fixing point on the guide frame; and wherein the first and second pulleys or fixing points on the guide frame are adjacent one another so that, in use, two lengths of the cable extending between the handle pulley and the first and second pulleys or fixing points respectively are substantially parallel.

4. The guide apparatus according to claim 1, wherein the guide is a guide rail comprising a groove for receiving a guide portion of the router housing.

5. The guide apparatus according to claim 1, wherein the guide frame is pivotable with respect to the base to alter the incline of the guide path with respect to a workpiece.

6. The guide apparatus according to claim 1, wherein a router-receiving portion of the router housing is pivotable with respect to a guide portion of the housing engageable with the guide, and wherein the router-receiving portion is pivotable with respect to the guide portion, so that in use the incline of a router bit of a router received in the housing with respect to the guide path is adjustable.

7. The guide apparatus according to claim 1, further comprising a depth gauge for setting a maximum depth for a routing operation, the depth gauge comprising a first gauge part constrained to move with the router housing and a second gauge part slidably coupled to the guide frame, wherein the first and second parts are configured to engage with one another so that the second part limits the range of movement of the router housing along the guide path in the engagement direction.

8. The guide apparatus according to claim 7, further comprising a main scale carried by or fixed with respect to the first gauge part, and a vernier scale carried by the second gauge part.

9. The guide apparatus according to claim 7, wherein the first gauge part comprises a shoulder or stop arranged to abut the second gauge part, and wherein the shoulder or stop is disposed at least 70% along the length of the guide towards the end of the guide opposite the base.

10. The guide apparatus according to claim 8, wherein the depth gauge is:

arranged so that the zero offset point of the main scale and vernier scale is separated from the workpiece along a direction parallel with the guide path by a distance of at least 10 cms, or by a distance of at least twice the maximum depth that can be set using the depth gauge; or configured so that a depth can be set for a routing operation of at least 15 cms.

11. The guide apparatus according to claim 7, wherein the second gauge part comprises a lock for locking its position with respect to the guide frame.

12. The guide apparatus according to claim 1, wherein the actuation mechanism is configured so that the router housing moves along the guide path in the disengaging direction when a grab-portion of the handle for receiving an input force from the operator moves in a direction substantially opposite the disengaging direction.

13. A router apparatus comprising a guide apparatus in accordance with claim 1 and a woodworking router received in the housing.

14. The router apparatus according to claim 13, further comprising a router table, wherein the guide apparatus is coupled to the router table so that the engaging direction is generally upward.

15. A method of operating the router apparatus according to claim 14, the method comprising coupling an actuator to the actuation mechanism, and coupling the actuator to a controller for carrying out a predetermined router operation.

* * * * *